US007090303B2

(12) United States Patent
Kropa

(10) Patent No.: US 7,090,303 B2
(45) Date of Patent: Aug. 15, 2006

(54) REHABILITATION TRAINING AND EXERCISE CHAIR

(76) Inventor: William Kropa, 352 Humphrey St., Swampscott, MA (US) 01907

( * ) Notice: Subject to any disclaimer, the term of this patent is extended or adjusted under 35 U.S.C. 154(b) by 0 days.

(21) Appl. No.: 10/455,286

(22) Filed: Jun. 5, 2003

(65) Prior Publication Data

US 2004/0245836 A1 Dec. 9, 2004

(51) Int. Cl.
*A47C 7/50* (2006.01)
*A47C 20/00* (2006.01)
*A61G 15/12* (2006.01)

(52) U.S. Cl. ..... 297/466; 297/487; 297/488; 297/201; 297/312; 297/423.1; 297/423.11; 297/423.12; 297/423.19; 297/423.22; 297/423.25; 297/423.26

(58) Field of Classification Search ..... 297/423.11, 297/423.12, 423.26, 487, 488, 201, 312, 297/466, 423.19, 423.22, 423.25, 423.1
See application file for complete search history.

(56) References Cited

U.S. PATENT DOCUMENTS

| | | | | | |
|---|---|---|---|---|---|
| 485,277 | A | * | 11/1892 | Hunter | 297/466 |
| 1,025,953 | A | * | 5/1912 | Hallen | 297/487 |
| 2,568,988 | A | * | 9/1951 | Bentley | 297/478 X |
| 2,858,876 | A | * | 11/1958 | Woodson, Jr. | 297/488 X |
| 3,145,053 | A | * | 8/1964 | Thompson et al. | 297/488 X |
| 3,173,722 | A | * | 3/1965 | Italo | 297/466 X |
| 3,338,626 | A | | 8/1967 | Hamilton | |
| 3,708,201 | A | | 1/1973 | Lamkeyer | |
| 3,754,787 | A | | 8/1973 | Garber | |
| 4,190,287 | A | * | 2/1980 | Lemisch et al. | 297/466 |
| 4,451,086 | A | | 5/1984 | Seven | |
| 4,607,882 | A | | 8/1986 | Opsvik | |
| 4,650,249 | A | | 3/1987 | Serber | |
| 4,662,361 | A | | 5/1987 | Patterson | |
| 4,736,982 | A | * | 4/1988 | Hwang | 297/423.12 X |
| 4,767,159 | A | * | 8/1988 | Opsvik | 297/423.11 |
| 4,832,407 | A | | 5/1989 | Serber | |
| 4,943,117 | A | | 7/1990 | Brown | |
| 5,040,522 | A | | 8/1991 | Daniels | |
| 5,054,857 | A | * | 10/1991 | Kvalheim | 297/423.12 X |
| 5,295,728 | A | * | 3/1994 | Schaevitz | 297/423.12 X |
| 5,342,116 | A | * | 8/1994 | Walton | 297/466 |
| 5,401,078 | A | | 3/1995 | Riach | |
| 5,487,590 | A | | 1/1996 | Haynes | |
| 5,490,716 | A | * | 2/1996 | Naughton | 297/423.12 |
| D369,691 | S | | 5/1996 | Haynes | |
| 5,582,464 | A | * | 12/1996 | Maymon | 297/487 |
| 5,713,632 | A | * | 2/1998 | Su | 297/312 |
| 5,806,929 | A | * | 9/1998 | Choi | 297/466 X |
| 5,887,948 | A | | 3/1999 | Hannes | |
| 6,086,157 | A | * | 7/2000 | Toso | 297/423.11 |
| 6,123,392 | A | | 9/2000 | Alfred et al. | |
| 6,349,993 | B1 | * | 2/2002 | Walsh | 297/466 |
| 6,378,947 | B1 | * | 4/2002 | Barber et al. | 297/466 X |
| 6,394,547 | B1 | * | 5/2002 | Vik | 297/423.26 X |
| 6,481,795 | B1 | | 11/2002 | Pettibon | |
| 6,565,154 | B1 | * | 5/2003 | Davis | 297/487 X |
| 6,619,747 | B1 | * | 9/2003 | Ko et al. | 297/423.12 |
| D499,259 | S | * | 12/2004 | Bjurman | 297/423.1 X |
| 2004/0251725 | A1 | * | 12/2004 | Jenkins | 297/466 X |

FOREIGN PATENT DOCUMENTS

| | | | | |
|---|---|---|---|---|
| DE | 4306918 A1 | * | 9/1994 | 297/118 |

* cited by examiner

*Primary Examiner*—Rodney B. White
(74) *Attorney, Agent, or Firm*—Gary E. Lambert; Lambert & Associates

(57) ABSTRACT

A rehabilitation training and exercise chair where the user can sit comfortably for long periods of time is provided. The chair is comprised of a base having wheels and is coupled to a shaft on one end. The shaft is coupled to a seat on its top end. The seat has an adjustable inclination so the correct ergonomics may be realized for the pelvis and lower spine. A front support bar with an adjustable length is connected to the seat and can be pivoted back or forward. The front support bar has a cushioned front support which rests against a user's abdomen. Furthermore, abductor and adductor extensions are attached to the seat, and foot extensions attached to the base for isometric exercises.

3 Claims, 3 Drawing Sheets

REHABILITATION TRAINING AND EXERCISE CHAIR

BACKGROUND OF THE INVENTION

This invention relates to an ergonomically correct rehabilitation training and exercise chair. Specifically it relates to a chair that provides proper pelvis and lower spine support while also enabling the exercise of leg, abdominal, and hip muscles for rehabilitation and exercise purposes.

In many activities and occupations where sitting is required, one must often lean forward or take uncomfortable positions for prolonged periods of time to engage in the desired activity. This is especially true for dentists and doctors while performing medical procedures. Furthermore, today's society is such that many do not have the time or inclination to engage in sufficient exercise. This inactivity in combination with sitting in standard chairs for prolonged periods can cause muscle atrophy and improper blood flow. Furthermore, the poor posture from sitting in standard chairs can negatively effect the vertebrae and cause stress and strain on back muscles that can be not only uncomfortable but also ergonomically unhealthful. Moreover, those with joint or muscle impairment may be susceptible to even greater pain or further degradation of their condition.

To remedy such difficulty and potential discomfort, seats were developed where one sits in a reverse position with respect to otherwise standard seats. Such seats have a forward portion which would give support to the upper body as one leaned over. This therefore relieves stress and strain thereby giving greater comfort to those in a seated position.

Different approaches to meet such designs were taken. Such a device is displayed in U.S. Pat. No. 5,487,590 issued to Haynes. This device is a chair used to facilitate therapy, where a patient sits facing the back support of the chair, resting his face and chest against pads. However, because the chair is for therapy and the placement of the arm and face pads, it is impractical for use by dentists and doctors, or for exercise.

U.S. Pat. No. 4,607,882 to Opsvik discloses a chair in which the user has the option of facing toward or away from the back rest. The device disclosed by Opsvik is intended to provide a comfortable, supportive chair, which can be used in either of these two sitting positions. However, the disclosed device does not enable any rehabilitation treatment or exercise.

U.S. Pat. No. 3,754,787 to Garber discloses a surgeon's chair for use in the operating room where the user sits facing the back of the chair. The device disclosed by Garber is intended to provide a comfortable way to sit/stand for a prolonged period of time while performing surgery. However, a user of such a device lets their legs hang down and rest on the floor. In order to reach forward, the user must maintain contact with the floor and push upon it to retain stability and adjust position.

Therefore, none of these disclosed devices enable someone to overcome the detrimental causes and effects that result from general inactivity and remaining seated for long periods of time.

Thus, what is needed is a chair that provides a more ergonomically correct positioning for the pelvis and lower spine, and at the same time enables muscle and joint training and exercise for the improvement of any impairments and the overall health of an individual.

SUMMARY OF THE INVENTION

The present invention advances the art of reverse seated chairs by providing improved ergonomics, greater comfort, stability and means for rehabilitation, training and exercise. Such training and exercise can be done during work or other seated activity, and so allows the possibility of keeping fit during times that would not otherwise be available. Furthermore, such exercise makes one feel better physically and emotionally, as well as increasing energy levels and alertness.

Typically when one sits in a standard seat, a person leans forward over a patient or desk, and lets their legs rest on the floor. However, greater comfort can be derived by placing an abdominal support in the front of the chair rather than the back, inclining the seat forward, thereby allowing the user to rest forward while keeping the lower spine and pelvis in an ergonomically correct position. This places the pelvis and spine in a neutral forward inclination, permitting a person to sit passively wherein there is little or no muscle strain. Unless the pelvis is in this neutral position, the spine will be in hyperlordosis, which leads to neurological and spinal complications.

Additionally, the present device also has extensions on the side and base which allow a person seated in the chair to secure himself without having to reach to the ground. Moreover, such extensions allow one to exercise and improve physical fitness.

The present device is comprised of a chair with a base having a shaft coupled to its upper portion. Moreover, wheels can be attached to the bottom of the base to facilitate movement of the chair. The shaft can be adjusted to the proper height for the user, and locked into place. The seat portion is coupled to the shaft and can be inclined to a comfortable angle for the user, and locked into place. For optimal user comfort and positioning, the angle of inclination should be at least 30 degrees. A front support is connected to the seat configuration, and can be adjusted or pivoted toward or away from the seat configuration, and locked into place. Also, the height of the front support bar can also be adjusted and locked into place. The front support bar can have a cushion, which rests against the user's abdomen, and can be angled to the most comfortable position for the user, adjusted to the proper height for the user, and locked into place.

The seat configuration can have adjustable abductor and adductor extensions and pads, which could be adjusted to a comfortable position depending on the specific dimensions of a user. Differentiating, the abductor extension serves to engage the outer thigh whereas the adductor extension serves to engage the inner thigh. As a users sits in a chair, the extensions can be pressed inward or outward for exercise or training to strengthen and stretch the outer and inner thigh muscles, and hip flexors. In one embodiment, the extension would be non-moving and rigid thereby permitting isometric excises. In another embodiment, the extensions could allow slight movement during exercise, with an adjustable degree of resistance.

The base configuration could have retractable foot extensions and pads which could be used to provide resistance to the feet, allowing the user to stretch and strengthen leg muscles by various exercises. By flexing feet on top of foot extensions a user can stretch and strengthen calf muscles, or by placing the heels in front of the foot extensions, and pulling backwards one can strengthen hamstring muscles. Additionally, by placing the feet under the foot extensions and pulling upward, the user is allowed to stretch and strengthen the quadriceps (i.e. front thigh), hip flexor, and lower abdominal muscles. Furthermore, one could strengthen quadriceps and gluteus maximus by placing feet on the floor under the chair and pushing upwards.

Therefore, it is the object of the present invention to provide a means of ergonomically securing oneself for movement and comfort on a reverse seated chair.

It is a further object of the present invention to provide a rehabilitation, training and exercise chair wherein exercises can be performed while engaged in work or other seated activity.

It is another object of the present invention to provide a device which will rehabilitate, and strengthen various muscle groups including abductor, adductor, hip flexor, and groins.

Yet another object of the present invention is to provide a device which will rehabilitate, and strengthen various muscle groups including calves, quadriceps, lower abdominal, hamstring muscles and gluteus maximus.

These and other features, aspects and advantages of the present invention will become better understood with reference to the following description, claims, and accompanying drawings. Therefore the form of the invention as set out above should be considered illustrative and not as limiting the scope of the following claims.

DETAILED DESCRIPTION OF THE INVENTION

Figure 2:
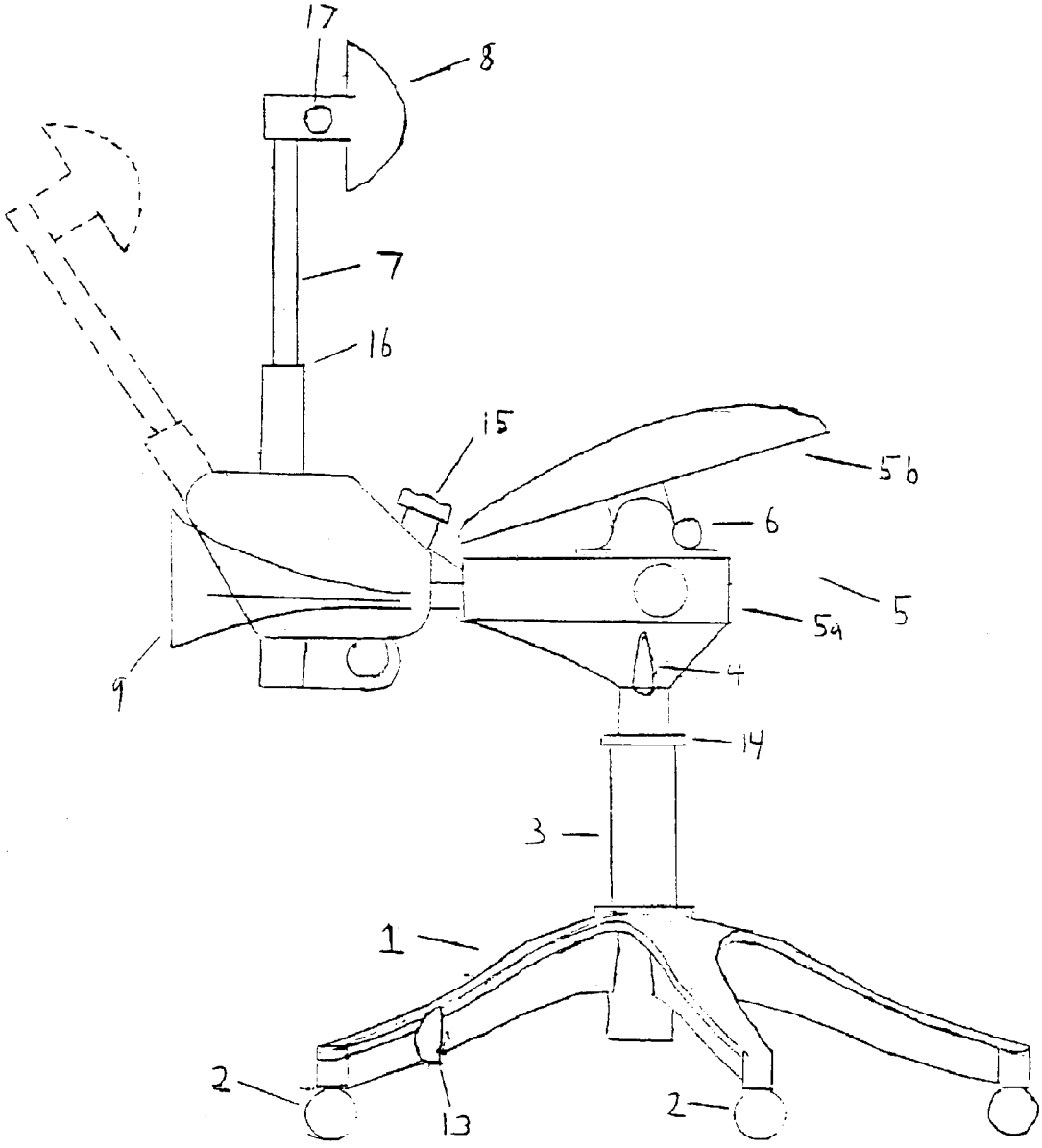
FIG. 2 is a side elevational view of an embodiment of the rehabilitation training and exercise chair.
Figure 3:
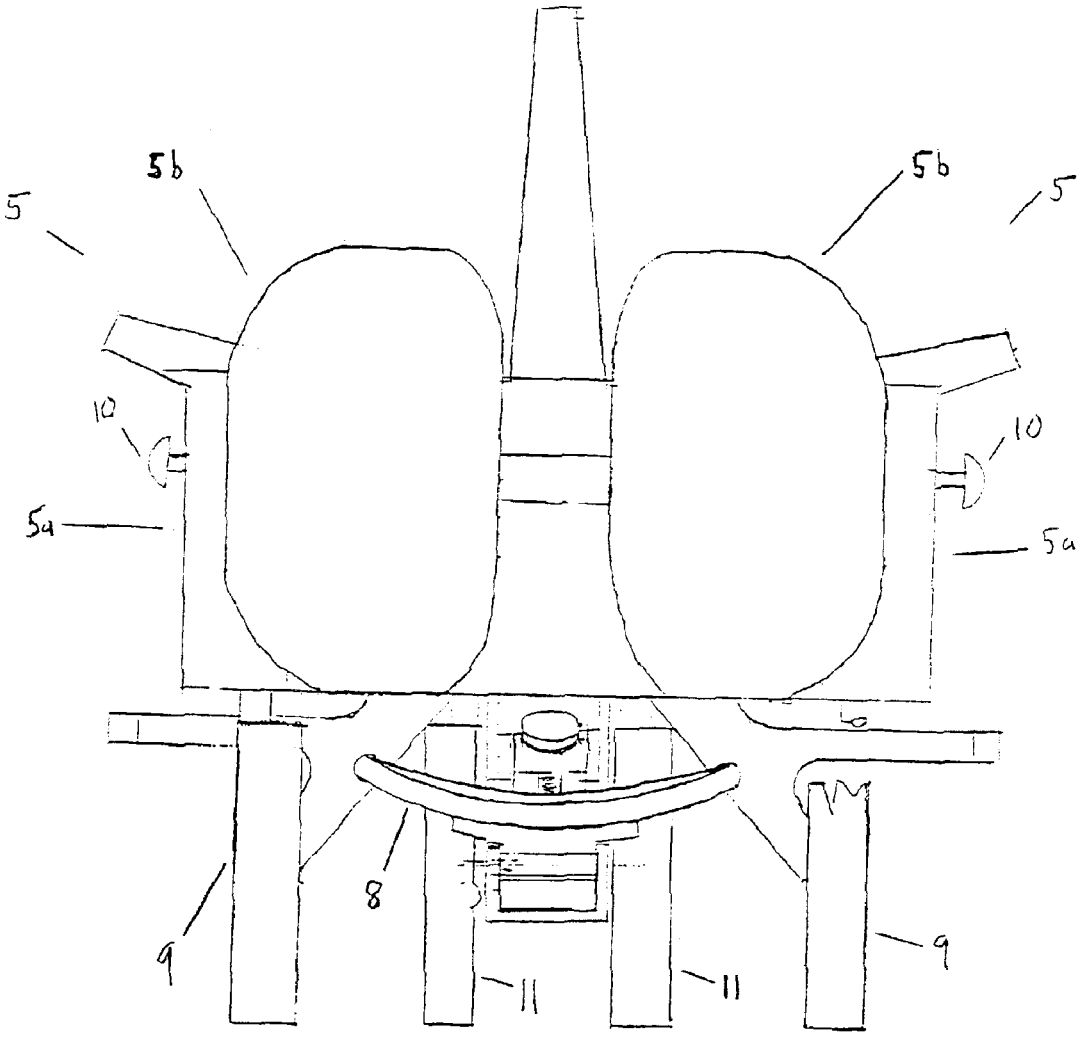
FIG. 3 is a plan view of an embodiment of the rehabilitation training and exercise chair.

An embodiment of a rehabilitation strengthening and exercise chair is displayed in FIG. 2. The chair is comprised of a base 1 with wheels 2 to allow user free movement of the chair while sitting. A shaft 3 is coupled to the base 1 wherein the length is adjustable and can be locked in place by shaft controller 4. The length of the shaft can be adjusted by telescoping tubes 14 that can lock in place. The seat 5 is coupled to the shaft 3. The angle of the top surface of the seat can be adjusted by angle controller 6.

A front support 7 is coupled to the seat 5 and can be pivoted toward or away from the seat 5 and locked in any position by front support controller 15. Also, the length of the front support is adjustable by a front support telescoping mechanism 16. A front abdominal support cushion 8 is coupled to the front support 7, wherein the angle of the abdominal front support cushion 8 can be adjusted by cushion controller 17. The chair is such that a user can sit on the seat configuration 5 facing the front support cushion 8, adjust the seat configuration 5 to a comfortable height and angle, adjust the front support bar 7 to the proper height to rest on the abdomen, and adjust the front support cushion 8 to a comfortable angle, in order to sit comfortably.

Figure 1:
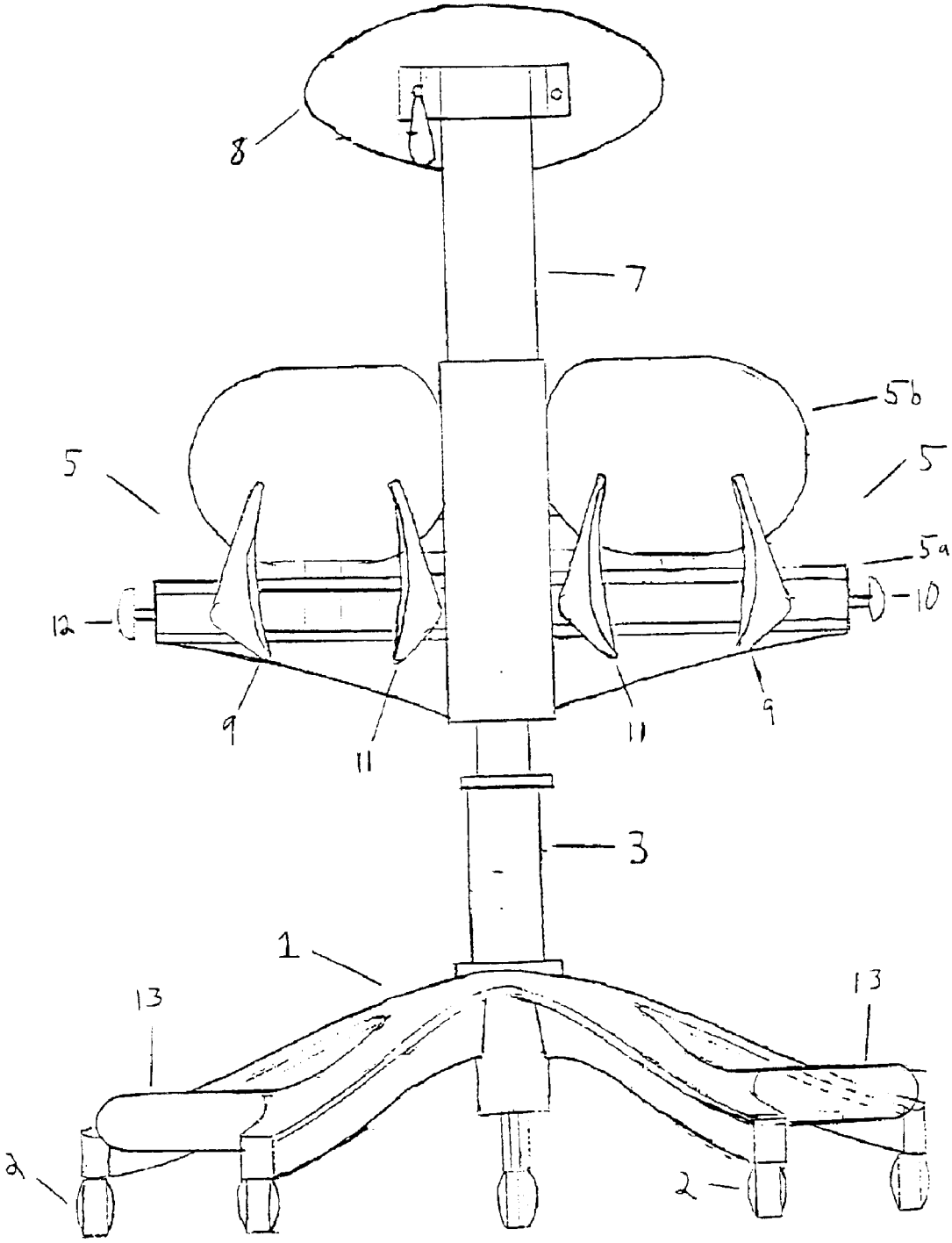
FIG. 1 is a front elevational view of an embodiment of the rehabilitation training and exercise chair.

A front elevational view of an embodiment of the present invention is shown in FIG. 1. In this embodiment, the chair has adjustable abductor extensions 9 which are attached to the seat configuration 5. The abductor extensions can be used to stretch and strengthen muscles such as outer thighs muscles, adductor, and hip flexors by pressing outwardly against the abductor extensions 9. The position of the abductor extensions 9 can be adjusted by controller 10.

Also in FIG. 1, the chair has adjustable adductor extension 11 which are attached to the seat 5. The adductor extensions can be used to stretch and strengthen muscles such as inner thigh muscles, hamstrings, groins and adductor muscles by pressing inwardly against the adductor extensions 11. The position of the adductor extensions 11 can be adjusted by controller 12.

In one embodiment, the extensions are rigid and unmoving for the purpose of isometric exercise. A user would press against the extensions and hold for a specific period of time. This would be repeated in sets according to the desire of the user. In another embodiment, resistance provided by the abductor and adductor extensions can be the inherent flexibility of the extensions themselves. For example, when a user applies leg pressure to an abductor extension, the stress to the extension will cause it to flex outward. Alternatively, when leg pressure is applied to an adductor extension, the stress to the extension will cause it to flex inward. Therefore, a material should be used so that the extensions should be rigid enough so that a user will have to exert energy to cause flex, however, not so rigid that flexing of the extension is impossible. The extensions thereby provide resistance while flexing. Another embodiment can include slight pivoting movement of the extensions. The resistance provided could be due to elastic material attached to the extension that can stretch when pressure is applied to the extensions. Furthermore, weight or large spring mechanisms during pivoting could provide resistance, or other means known in the art.

In another embodiment of the present invention, depicted in a side view in FIG. 2, the chair has retractable foot extensions 13 which are attached to the base configuration 1. By placing toes beneath the extensions 13 and lifting, the upper quadriceps and hip flexors can be strengthened. Also, by placing the heel in front of an extension 13 and pressing back, the hamstring can be exercised. Furthermore, placing the foot on top of the foot extensions and pressing downward, the calf muscles can be strengthened. The resistance provided by the foot extensions can be the inherent rigidity of the foot extension itself, wherein the foot extensions do not flex when force is applied. In another embodiment, the foot extensions could flex slightly when force is applied. Further embodiments can include foot extensions that pivot when force is applied. Furthermore, resistance in such cases can be elastic material, spring loaded mechanisms or weights.

An additional chair exercise consists of placing one's feet on the floor under the chair and pushing upwards. Such an exercise strengthens quadriceps and the gluteus maximus.

In the preferred embodiment of the present invention, depicted in FIGS. 1–2, the chair is comprised of a base 1 with wheels 2 to allow a user free movement of the chair while sitting. A shaft 3 is coupled to the base configuration 1 wherein the length is adjustable and can be locked in place. In the preferred embodiment, the seat 5 can be divided into a lower subsection 5*a* and an upper subsection 5*b*. The upper subsection 5*b* is extended upward from the lower subsection so as to receive the bottom of a sitter, and can be concave and cushioned for greater comfort. Furthermore, the upper subsection 5*b* is split in the middle in order to relieve pressure on the perineum. Without this split, prolonged pressure in that area can lead to impotence and numbness of the genitalia. Controller 6 can be used to adjust the angle of upper subsection 5*b* thereby allowing correct ergonomic positioning of the pelvis and lower spine. The lower subsection 5*a* provides support and interconnection with other elements of the chair. The lower subsection 5*a* is coupled to the shaft 3. A front support 7 is coupled to the lower subsection 5*a*, and can be pivoted toward or away from the seat 5, and locked in any position. The length of the front support is telescopically adjusted.

A front support cushion 8 is attached to the front support 7 wherein the angle of front support cushion 8 is adjustable. Abductor extensions 9 are attached to the lower subsection 5*a* and can be pressed outward thereby allowing a user to stretch and strengthen outer thigh muscles, adductor, and hip flexors. The position of the abductor extensions can be adjusted by use of controller 10. The chair also has removable adductor extensions 11, which are attached to the lower subsection 5*a*, wherein a user can stretch and strengthen inner thigh muscles, hamstrings, groins and adductor muscles by pressing inwardly against the adductor extensions 11. Controller 12 can be used to adjust the position of the adductor extensions 11. The extensions in the preferred embodiment are rigid and unmoving to allow for isometric exercising. The chair has retractable foot extensions 13 which are attached to the base configuration 1 in order to allow exercise of the lower legs. The calf, quadriceps, abdomen, and hamstring muscles can be exercised by either flexing feet and legs on top, underneath or behind foot extensions 13. The resistance provided by the extensions is the inherent rigidity of the extensions themselves.

It will be further understood that the embodiments described herein are merely exemplary, and that a person skilled in the art may make variations and modifications without departing from the spirit and scope of the invention. All such variations and modifications are intended to be included within the scope of the appended claims.

What is claimed is:

1. A rehabilitation training and exercise chair comprising:

a base having an upper portion and a lower portion, a shaft having a top end and a bottom end, wherein said bottom end is coupled to said upper portion of said base;

a seat coupled to said top end of said shaft;

a front support coupled to said seat wherein said front support extends in an upward direction;

at least one adductor extension extending from one side of said seat;

at least one adductor extension extending from a second side of said seat such that there is at least one adductor extension on each side of said seat;

said adductor extensions extend from a lower subsection of said seat;

said adductor extensions are substantially rigid to facilitate isometric exercise;

said adductor extensions are sufficiently flexible to provide resistance while flexing; and said adductor extensions have a means for adjusting position of said adductor extensions.

2. The chair as in claim 1 wherein said adductor extensions are inwardly pivotable.

3. The chair as in claim 2 wherein said adductor extensions possess a means for providing resistance so that a force must be applied for extensions to pivot.

* * * * *